US011786791B2

(12) United States Patent
Schulz et al.

(10) Patent No.: US 11,786,791 B2
(45) Date of Patent: Oct. 17, 2023

(54) 3-DIMENSIONAL GOLF GAME

(71) Applicants: Christopher Schulz, Laguna Hills, CA (US); Nathaniel Dilger, Dana Point, CA (US)

(72) Inventors: Christopher Schulz, Laguna Hills, CA (US); Nathaniel Dilger, Dana Point, CA (US)

( * ) Notice: Subject to any disclaimer, the term of this patent is extended or adjusted under 35 U.S.C. 154(b) by 0 days.

(21) Appl. No.: 18/103,658

(22) Filed: Jan. 31, 2023

(65) Prior Publication Data

US 2023/0181984 A1 Jun. 15, 2023

Related U.S. Application Data

(63) Continuation of application No. 17/742,140, filed on May 11, 2022, now Pat. No. 11,577,135, which is a continuation of application No. 16/717,877, filed on Dec. 17, 2019, now abandoned.

(60) Provisional application No. 62/782,864, filed on Dec. 20, 2018.

(51) Int. Cl.
*A63B 67/02* (2006.01)
*A63B 71/06* (2006.01)

(52) U.S. Cl.
CPC ..... *A63B 67/02* (2013.01); *A63B 71/0669* (2013.01); *A63B 2210/50* (2013.01); *A63B 2225/50* (2013.01)

(58) Field of Classification Search
CPC . A63B 67/02; A63B 71/0669; A63B 2210/50; A63B 2225/50
USPC ..... 473/153, 157, 160, 162, 163, 193–197
See application file for complete search history.

(56) References Cited

U.S. PATENT DOCUMENTS

| | | | |
|---|---|---|---|
| 920,907 | A | 5/1909 | Bolton |
| 1,531,880 | A | 3/1925 | Ritter |
| 1,582,237 | A | 4/1926 | Angell |
| 2,224,962 | A | 12/1940 | Hines |
| 2,455,185 | A | 11/1948 | May |
| 3,409,301 | A | 11/1968 | Studen |
| 3,758,116 | A | 9/1973 | Pieronek |
| 3,825,262 | A | 7/1974 | Grzybowski et al. |
| 4,129,916 | A | 12/1978 | Schlesinger et al. |
| 4,523,760 | A | 6/1985 | Bednarczuk |
| 5,042,813 | A | 8/1991 | Huang |
| 5,165,690 | A | 11/1992 | Kelley, Jr. |
| 5,294,913 | A | 3/1994 | Mower et al. |
| 5,306,009 | A | 4/1994 | Bolanos |
| 5,418,517 | A | 5/1995 | Matherne et al. |
| 5,492,319 | A | 2/1996 | Lee |
| 5,655,972 | A | 8/1997 | Heitzman |
| 6,389,368 | B1 | 5/2002 | Hampton |

(Continued)

*Primary Examiner* — Nini F Legesse
(74) *Attorney, Agent, or Firm* — ONE LLP

(57) ABSTRACT

A 3-Dimensional golf game having a horizontal surface, a vertical surface, and a curvilinear surface that interconnects the horizontal and vertical surfaces, wherein at least the vertical surface includes one or more ball-receiving cups. The game of skill is played by one or more players putting or striking a golf ball along the horizontal surface with sufficient force to travel through the curvilinear surface and up the vertical surface. The force of gravity then causes the ball to return back down the vertical surface and—if appropriately aimed and struck—the ball travels downwardly into the opening of the least one ball receiving cup. Players are awarded points for successfully landing the ball into the ball receiving cup and the game may include differently sized and/or positioned cups having different point values.

5 Claims, 9 Drawing Sheets

(56) References Cited

U.S. PATENT DOCUMENTS

| | | | |
|---|---|---|---|
| 8,216,083 | B1 | 7/2012 | Masucci |
| 9,592,430 | B1 | 3/2017 | Pollard |
| 2003/0125121 | A1 | 7/2003 | Rhee |
| 2010/0081513 | A1 | 4/2010 | La Pointe |
| 2017/0340949 | A1 | 11/2017 | Tsai |

3-DIMENSIONAL GOLF GAME

CROSS-REFERENCE TO RELATED APPLICATIONS

The present application is a continuation of U.S. patent application Ser. No. 17/742,140, filed May 11, 2022, which is a continuation of U.S. patent application Ser. No. 16/717,877, filed Dec. 17, 2019, now abandoned, which claims priority to U.S. Provisional Patent Application No. 62/782,864 filed Dec. 20, 2018, the disclosures of all of which are hereby incorporated by reference in their entireties.

FIELD OF THE INVENTION

The present invention relates to games of skill, and more particularly to a miniature 3-Dimensional golf game.

BACKGROUND OF THE INVENTION

There are many well-known games of skill that are enjoyed by children and adults alike.

For example, miniature golf is played on a smaller scale course having a plurality of individual sequential "holes", each comprising a tee-off area (i.e. the designated starting point) and a recessed cup positioned at a distance from the tee-off area into which a player attempts to putt a golf ball to conclude play of the corresponding hole. Such games are generally designed so that players complete the course—which typically includes 9 or 18 holes—using as few strokes as possible to putt the golf ball into the cup of each hole. Smaller versions of golf games have also been known for many years, which are suitably sized for use in bars, recreation centers, arcades and game rooms. One such game is described at U.S. Pat. No. 1,582,237, the contents of which are incorporated by reference as is set forth fully herein.

As another example, darts can be played by throwing one or more darts at a cork or electronic dartboard to gain points or attain other goals (sequential numbers, etc.). One example of such a dart game is shown at U.S. Pat. No. 3,409,301, the contents of which are incorporated by reference as is set forth fully herein.

As yet another example, the well-known game commonly referred to as "Skee Ball" has been played for many years. This game also has a smallish size appropriate for use in bars, recreation centers, arcades and game rooms. The game is played by one or more players that roll balls up a ramp towards deflecting obstructions. Upon hitting the obstructions, the balls bounce up into one or more numbered alleys or channels, each of which may represent different score values. One version of this game is described at U.S. Pat. No. 1,531,880, the contents of which are incorporated by reference as is set forth fully herein.

BRIEF DESCRIPTION OF THE DRAWINGS

The present invention will now be described by way of example with reference to the following drawings. Of course, those of skill in the art will understand that a number of variations may be made in the disclosed embodiments, all without departing from the scope of the invention.

DETAILED DESCRIPTION OF THE INVENTION

Figure 1:
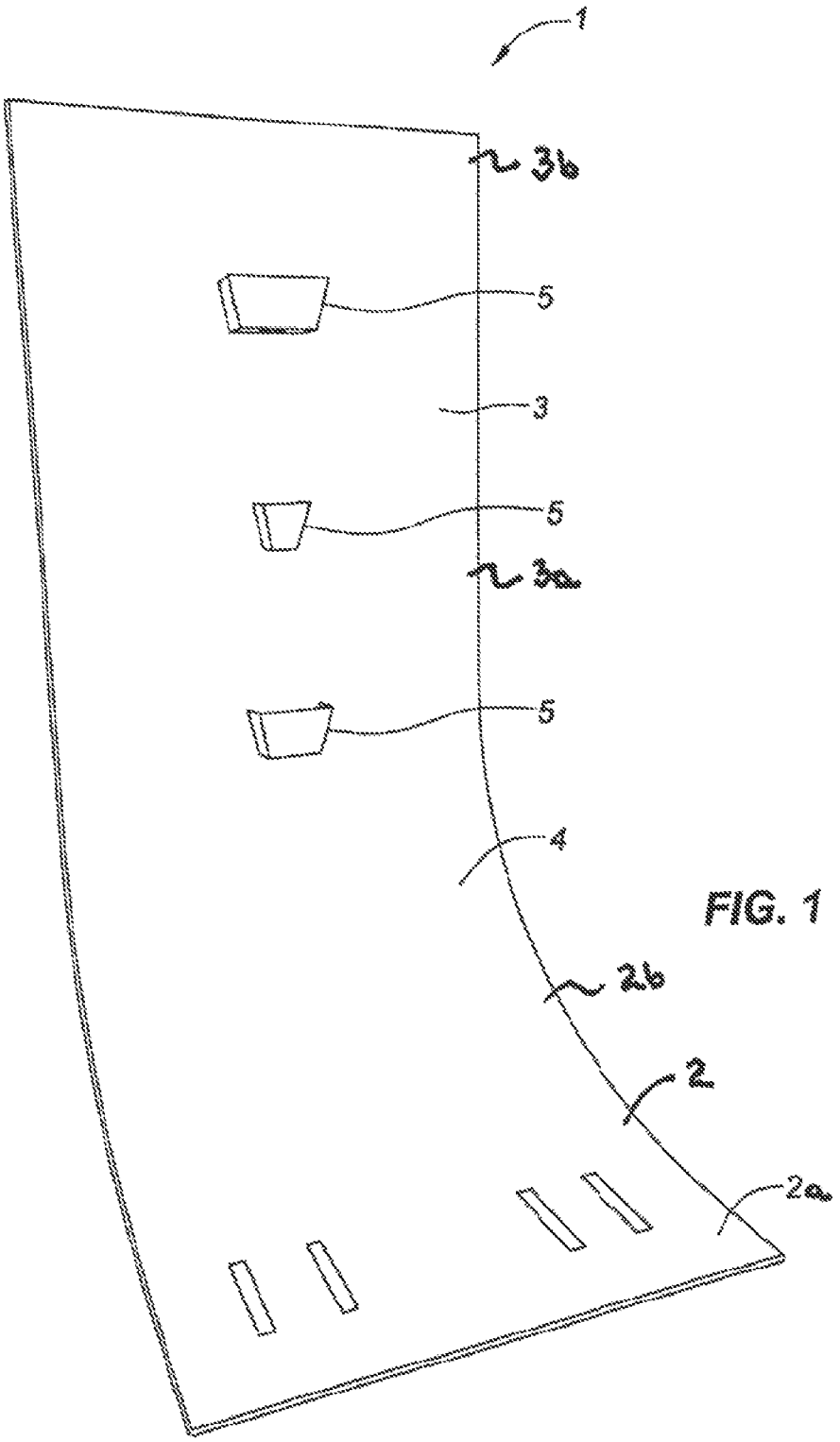
FIG. 1 shows a front view of an exemplary embodiment of the described invention.

The present invention comprises a 3-dimensional golf game 1 that is appropriately sized for use in bars, recreation centers, arcades, game rooms, conventions, and promotional events. The game 1 includes a horizontal surface 2 having a first end 2*a* and a second end 2*b*, a vertical surface 3 having a first end 3*a* and a second end 3*b*, and a curvilinear surface 4 that interconnects the second end 2*b* of the horizontal surface 2 with the first end 3*a* of the vertical surface 3, wherein at least the vertical surface 3 includes one or more ball-receiving cups 5 mounted thereon.

Figure 6A:
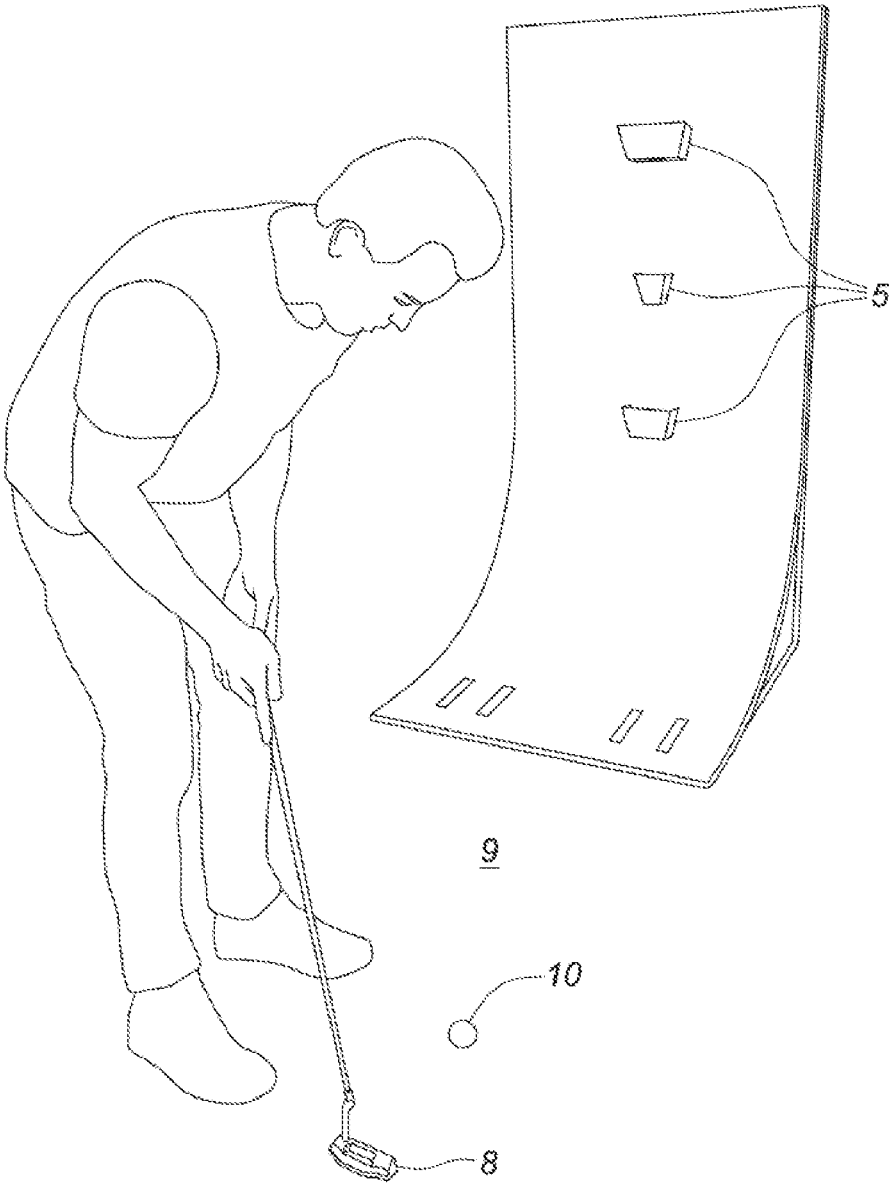
FIG. 6*a* shows one view of an exemplary embodiment of the described invention during game play.

In one embodiment, the game includes a plurality of ball-receiving cups 5 arrayed in various arrangements on at least the vertical surface 3. Depending on the location and/or size of the cup 5, various points may be awarded during game play for successfully landing the ball 10 into that cup. Cups 5 may also be provided in specific patterns and may also be included on the curvilinear surface 4. As shown above, the cups 5 are substantially square, but in another embodiment, the cups 5 would be cylindrical-shaped or half-cylindrical shaped. But in each embodiment, the cups 5 would have an open upwardly-facing cup mouth 6, wherein during game play the player endeavors to putt the golf ball 10 from a tee-off position with sufficient force that the ball travels past the at least one ball-receiving cup (FIG. 6*c*) and then back down into the upwardly facing cup mouth 6.

In one embodiment, the game surface is between 60 to 84 inches long and 24 to 48 inches wide. In another embodiment, the game surface is roughly twice as long as it is wide. In a preferred embodiment, the game is approximately 72 inches long and 36 inches wide. The game surface itself is preferably of a plastic or nylon type material that allows some rigidity, but may still be rolled into a roll when not in use to allow easy storage and transportation. The game surface may include a lip or other retaining feature at the terminal end closest to the player. This feature means that following a shot, the ball strikes and is retained from rolling past the retaining feature, i.e., the ball 10 does not easily "escape" from the field of game play. Otherwise, the ball will roll freely and must be stopped and retrieved by the player after each shot.

The ball-receiving cups 5 have an open top 6 that is generally sized to receive the ball and may be shaped similar to a drinking cup or a coffee cup. They may also box shaped cup-shaped. In a preferred embodiment, they are shaped like a cup that has been cut down the middle (half-cylindrical) such that when connected to the game surface, the game surface forms the back side of the cup. Each cup may be closed at the bottom such that the ball 10 must be retrieved following a successful shot or it may have an opening 7 in the bottom such that it the ball passes through and is returned to the player following a successful shot.

Figure 2:
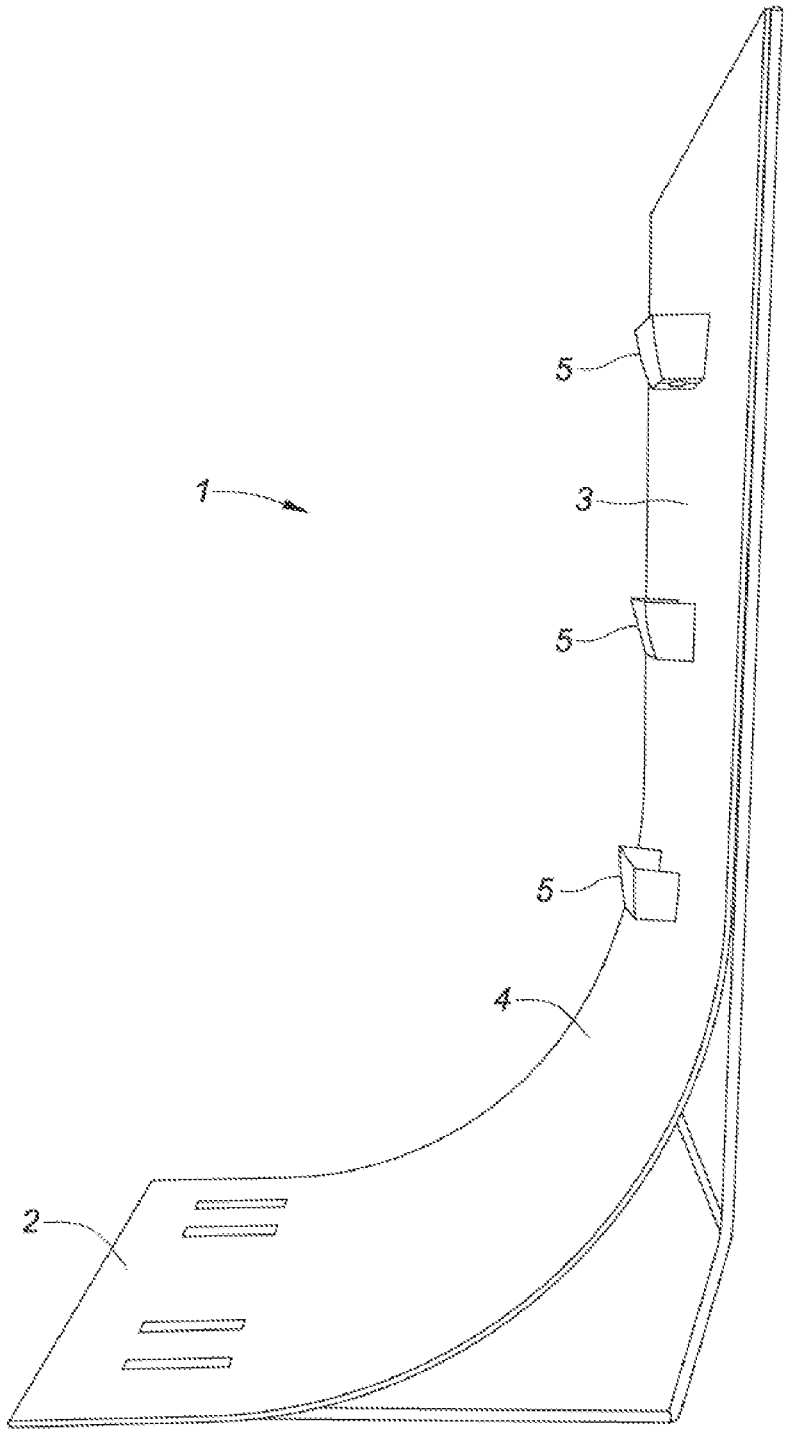
FIG. 2 shows a side view of an exemplary embodiment of the described invention.
Figure 3:
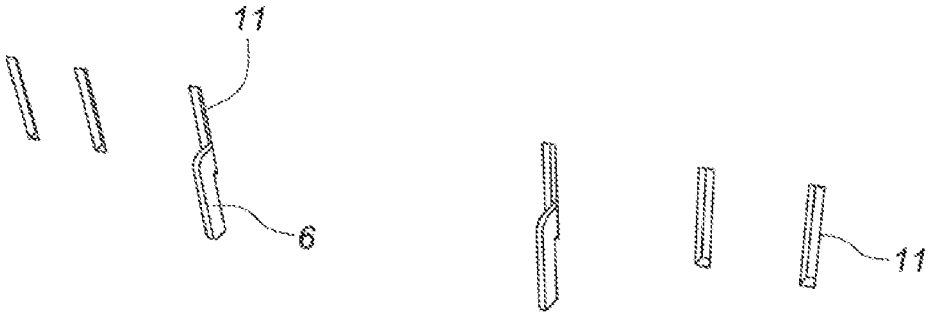
FIG. 3 shows a back view of an exemplary embodiment of the described invention showing a connection method involving tabs for connecting the ball receiving cups to the playing surface.
Figure 4:
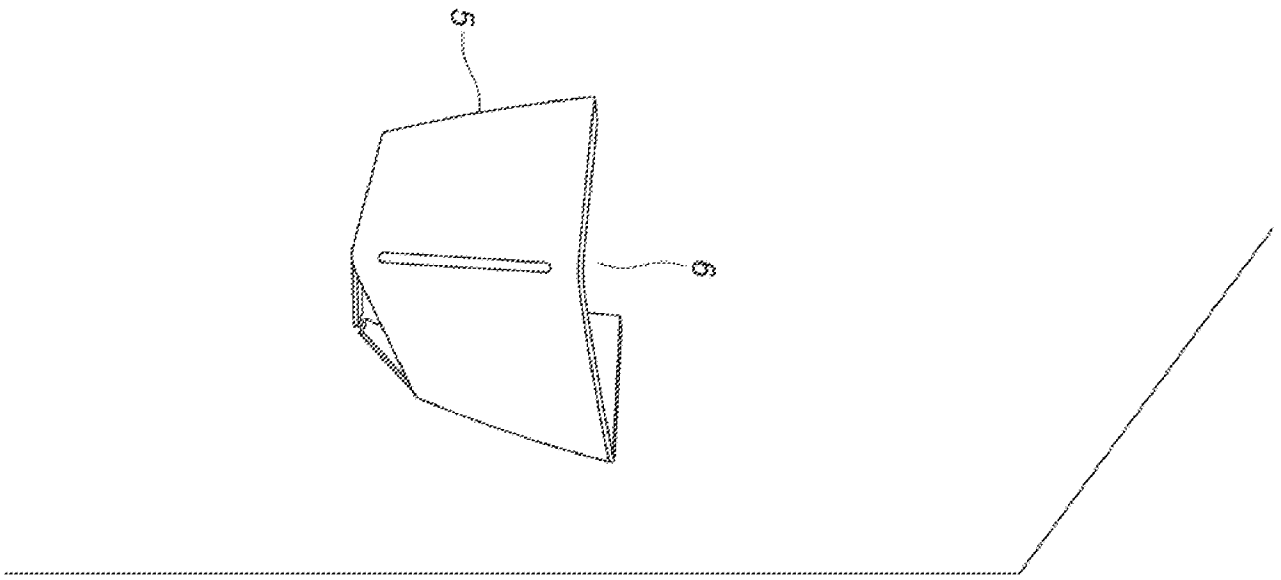
FIG. 4 shows one view of a ball receiving cup of the described invention.
Figure 5:
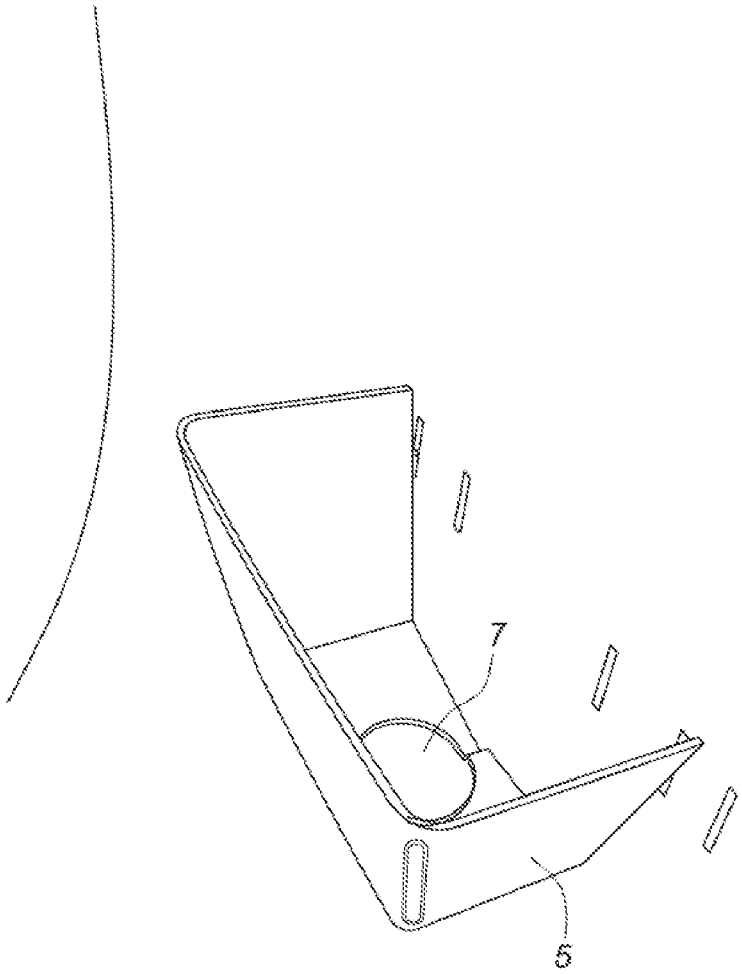
FIG. 5 shows a second view of a ball receiving cup of the described invention.

The cups 5 may be permanently or releasably connected to the game surface. If permanently attached, they may be connected using adhesive, rivets, tabs 6 (FIGS. 3, 5), tape, screws, or other well known fasteners. If releasably attached, they may be connected using hook and loop closures, tabs, ball-and-socket connecters, or other well known releasable attachment mechanisms. The same connection techniques may be used to connect the game surface to the floor and to an adjacent wall during game play. In an alternative embodiment best shown in FIG. 2, the game surface is supported using an easily assembled support structure and is thus self-supported without the need for a back wall.

Figure 6B:
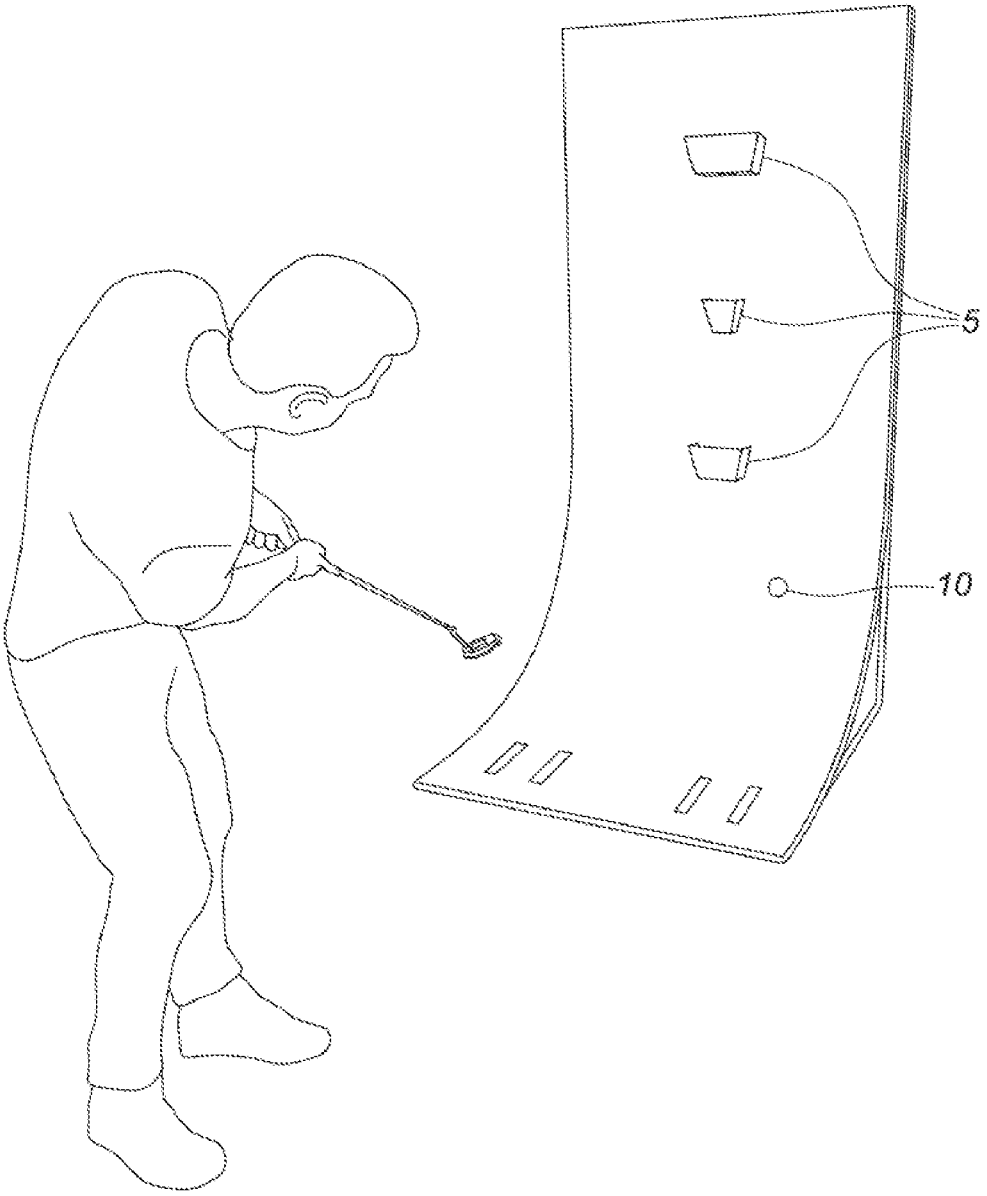
FIG. 6*b* shows one view of an exemplary embodiment of the described invention during game play.
Figure 6C:
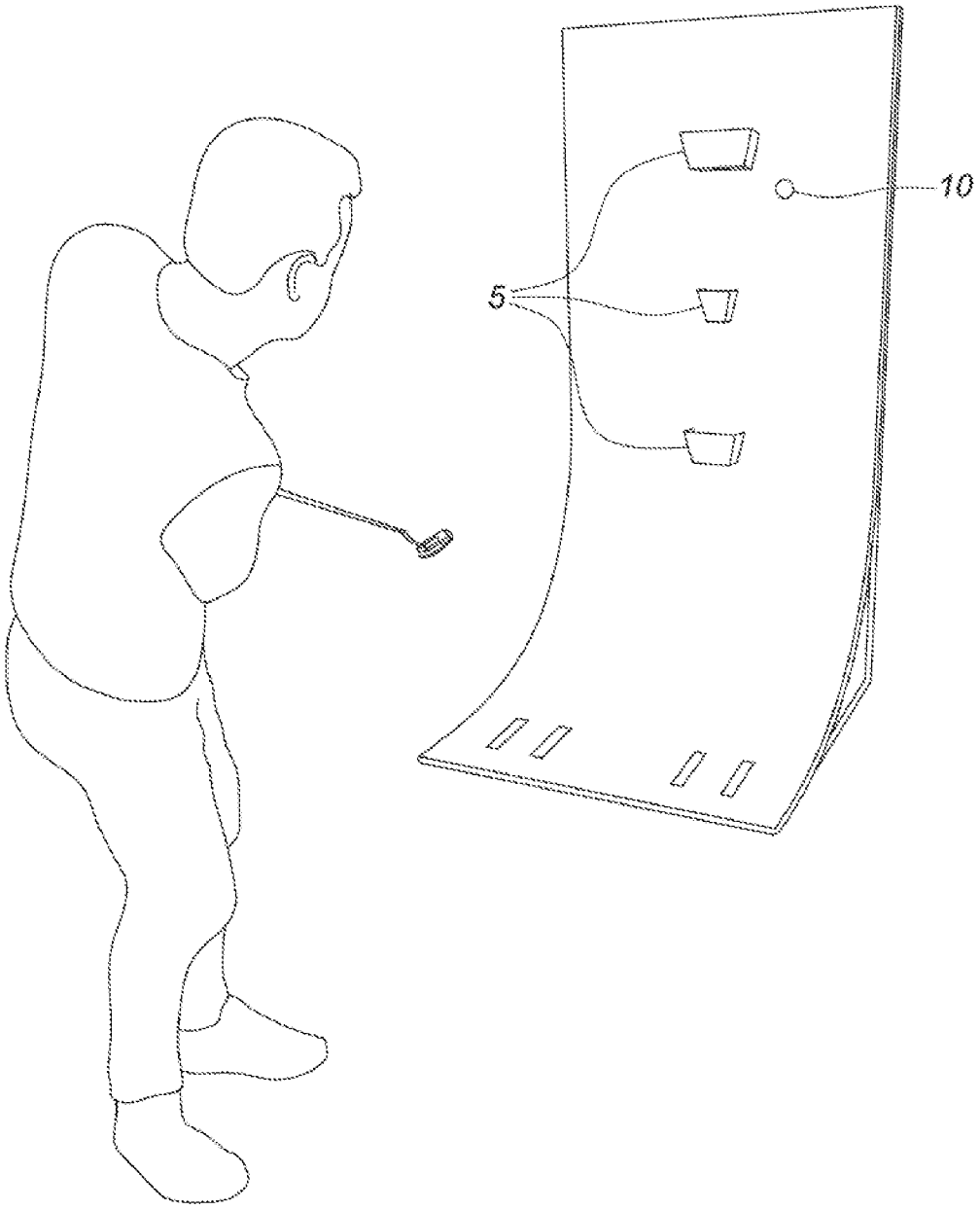
FIG. 6*c* shows one view of an exemplary embodiment of the described invention during game play.

A method for conducting a 3-Dimensional miniature golf game is provided. The method includes providing a playing surface comprising a horizontal surface 2. The game surface further includes a vertical surface 3 and a curvilinear surface 4 that interconnects the horizontal and vertical surfaces 2,3. The game further includes one or more ball-receiving cups 5 mounted to at least the vertical surface 3. The player begins game play by placing a ball 10 in a tee-off area. The tee-off area can be located on the end of the horizontal surface opposite the vertical surface. Alternatively, the tee-off area can be located some distance away from the horizontal surface on the floor 9 to thereby increase the player's distance from the target and to increase the difficulty of the shot. This alternative is shown, for example, in FIG. 6*a* above, and allows the length of the horizontal surface 2 to very short or almost non-existent, i.e., the playing surface largely consists of the curvilinear surface 4 and the vertical surface 3, with the ball first travelling some distance along the actual floor 9 before traveling up the curvilinear surface 4 (FIG. 6*b*).

During game player, the player strikes the ball 10 from a tee-off position proximate the first end 2*a* of the horizontal surface (preferably with a well known golf "putter" 8 or similar device) with sufficient force that it travels through the horizontal surface 2 from the first end 2*a* of the horizontal surface to the second end 2*b* of the horizontal surface (or floor 9), through curvilinear surface 4, and up the vertical surface 3 from the first end of the vertical surface 3*a* toward the second end of the vertical surface 3*b* with sufficient distance to travel past the at least one ball-receiving cup 5. If appropriately struck and aimed, the ball 10 will follow an arc that, upon returning down the game surface under the force of gravity, will terminate in one of the at least one ball-receiving cups 5. The game provides a point value for making such a shot.

In one embodiment, the point value for each of the ball receiving cups on the game surface is identical, i.e., the player can choose from one or more targets and—upon ending the ball in any ball-receiving cups—will achieve the same number of game points. In another embodiment, some cups may be smaller than others (or placed in a more difficult position) such that the player receives a higher point value for making a more difficult shot.

In one embodiment, the game is played with each player taking a turn. That turn can be one stroke per player or—more preferably—a plurality of strokes, e.g., three, for each player's turn. After a player's turn is complete, the player's points are tabulated and the next player's turn begins. The game can be measured by the most number of points after a set number of turns, e.g., 10 turns. Alternatively, game play can be measured by a set number of points, i.e., first player to 20 points wins the game.

In an alternative embodiment, instead of taking turns, each player takes their strokes at the same time as all other players. Two or more players would thus set their balls in the tee-off area to begin game play and then start the game concurrently with each other. In this embodiment, the players will be "racing" to achieve a certain score, e.g., first player to 20 points wins, regardless of how many strokes taken. This provides additional excitement as the players will need to move both quickly and skillfully as there will be incentive to take as many strokes as possible to reach the goal score first. This also allows additional excitement because—given that all players will be playing simultaneously—players will be in close quarters and can easily distract each other, attempt to divert balls that are in play or in the tee-off area, and engage in some lighthearted "cheating". In this alternative embodiment, the game surface can be fabricated such that all players use the same game surface to score points or—in the alternative—each player can have substantially similar field of play that is placed side-by-side with all fellow players.

Figure 7:
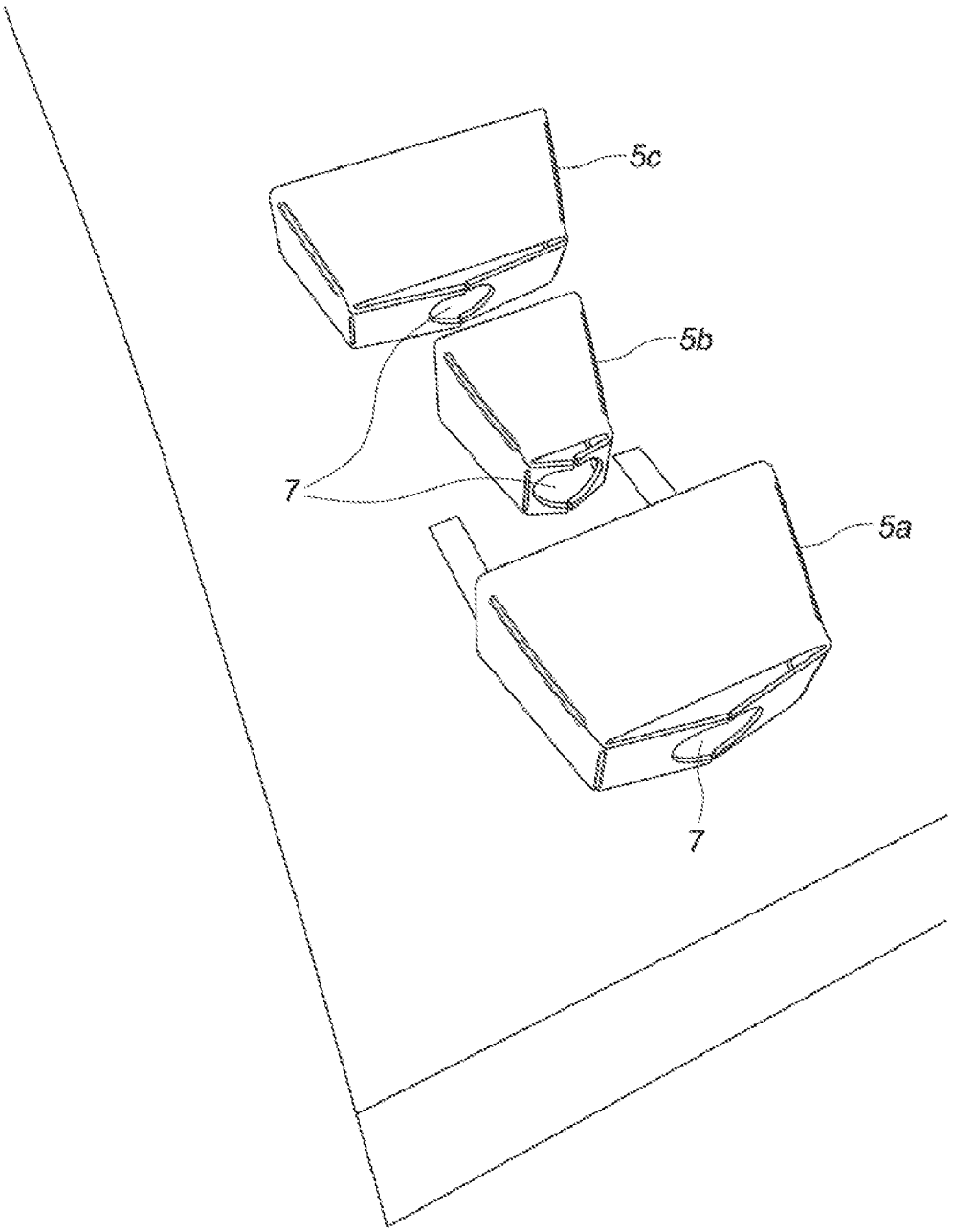
FIG. 7 shows alternatively sized ball receiving cups suitable for use with the described invention.

As noted above, the ball receiving cups can be variously sized (see FIG. 7) with larger cups 5*a* having lower point values (or providing easier game play, such as for younger players) and smaller cups (5*b*, 5*c*) for larger point values. They can also be arrayed in a variety of positions, e.g., a simple game including just one cup and more complex games including a half dozen or more cups in various sizes and configurations.

The game may be played using various scoring methods beyond simply points.

In one embodiment of the game, the game surface includes appropriate graphics and cup configuration for playing a golf-themed game. Scoring in this game may be played such that a player is given a set number of strokes, e.g., 2 or 3 strokes, to achieve a successful outcome. Certain cups may be labeled "par," "birdie," "eagle," and "bogie" or other similar familiar golf hole scores. Other cups—which may be larger or smaller as desired—may also be positioned that need to be avoided by the player, such as "sand trap," "water trap," and "out of bounds." The player's turn thus involves the player attempting with his strokes to achieve the most positive outcome, e.g., eagle, while avoiding negative outcomes and avoiding missing any outcome entirely (which could be labelled a "double bogie" in the above example). Scoring would thus involve taking the players most positive outcome, e.g., a birdie, and then subtracting any negative outcomes, e.g., perhaps a minus one stroke for a sand trap or a minus two strokes for water trap or out of bounds or lost ball. After both players complete the hole, the process can be completed for a complete round, e.g., 9 holes or 18 holes, with each player's score being totaled after the completion of the round.

In one embodiment of the game, the game surface includes appropriate graphics and cup configuration for playing a baseball-themed game. Scoring in this game may be played such that a missed stroke is a "strike" with each player given three "outs." Certain cups may be "home runs," "grand slams," "singles," "doubles" and other similar familiar baseball scoring events. Other cups—which may be larger or smaller as desired—may also be positioned that need to be avoided by the player, such as "out" and "double play" cups. The player's turn thus concludes upon achieving three outs, just as in baseball.

In another embodiment of the game, the game surface includes appropriate graphics and cup configuration for playing a football-themed game. Scoring in this game may be played such that a missed stroke is a "down" with each player given three tries for a successful outcome, i.e., a first down. Certain cups may be "first down," "touchdown," "field goal," and other similar familiar football terms. Other cups—which may be larger or smaller as desired—may also be positioned that need to be avoided by the player, such as "interception," "fumble," "safety" and other such negative events. The player's turn thus concludes upon achieving either a scoring event such as a "touchdown" or "field goal," or a negative event such as a "interception," "fumble," or "safety," or failing to achieve a first down or scoring event in a set number of attempts.

In another embodiment of the game, the game surface includes appropriate graphics and cup configuration for playing a basketball-themed game. Scoring in this game may be played such that a player is given a set number of tries (e.g., three tries) to achieve a successful outcome, i.e., a basket. Certain cups may be "foul shots," "baskets," and "three pointers." Other cups—which may be larger or smaller as desired—may also be positioned that need to be avoided by the player, such as "foul," "turnover," and other such negative events. The player's turn thus concludes upon achieving either a scoring event or achieving a negative event or failing to achieve either in a set number of attempts.

In any of the above alternatives, the player's turn could continue for a set number of attempts as long as no "turnover" type event is encountered.

The system may be further configured with an automatic scoring system and accompanying digital display that automatically tracks and displays each player's point total. Such systems are well known in the art and are described more fully at U.S. Pat. Nos. 6,389,368, 5,418,517, 5,294,913, and U.S. Patent Publ. No. 2017/0340949, the contents of which are incorporated by reference as is set forth fully herein. In one embodiment, each player's ball includes a microchip that allows the system to distinguish that ball from each other ball and to score and display each player's score separately, including simultaneously when more than one player is playing at the same time. The retaining feature may include a sensor that counts when the ball strikes it, such that the system may keep track of strokes played even if unsuccessful at landing in the cup. In a preferred embodiment, the system displays each player's scores simultaneously such that the players are encouraged to "race" each other and track their progress in real time versus their opponent. The system may also include wireless capability (e.g., Wi-Fi, Bluetooth, etc.) so that a player can connect their phone or tablet to the game and may also wirelessly share their results with other players and even compete against other players remotely.

The game could also include a mobile phone application that allows the player to keep and track scores directly on their phone, to post those scores, and to compare their scores against other players. In one embodiment, the mobile phone application could allow tracking of all players scores and to compare your score against the overall best score of all players for a give configuration. This mobile phone application could be wirelessly connected, via Bluetooth or Wi-Fi for example, to the electronic scoring mechanism described above.

The invention claimed is:

1. A game of skill device comprising:

a unitary and substantially smooth curvilinear game playing mat comprising:

a horizontal surface having a first end and a second end, wherein the first end is configured to lie substantially flat on a floor, a vertical surface having a first end and a second end, and a curvilinear surface that interconnects the second end of the first horizontal surface to the first end of the vertical surface;

an approximately golf-ball sized ball; and at least three ball-receiving cups, each ball-receiving cup having an upwardly-facing cup mouth and an opening opposite thereto that is larger than the approximately golf-sized ball, wherein each ball-receiving cup is fastened to the curvilinear surface or the vertical surface of the game play mat; and a golf putter;

wherein during gameplay a player places the ball at a tee-off position located proximate the first end of the horizontal surface and thereafter putts the ball with the golf putter with sufficient force and in the proper direction such that the ball rolls from the first end of the horizontal surface past at least one of the ball-receiving cups, the ball then reversing direction back into the upwardly facing cup mouth of the at least one ball-receiving cup.

2. The game of skill device of claim 1, wherein at least one ball-receiving cup has a differently sized upwardly facing cup mouth than at least one other ball-receiving cup.

3. The game of skill device of claim 1, wherein the player putts from a tee off position located on the floor proximate the first end of the horizontal surface.

4. The game of skill device of claim 1, further including an automatic scoring and display system configured to (a) automatically detect and award points for each instance that the player successfully putts the ball into a ball-receiving cup, and (b) display on a display device the cumulative points earned by the player during game play.

5. The game of skill device of claim 4, wherein the automatic scoring and display system awards points to a player for each instance that the player successfully putts the ball into a ball-receiving cup, and wherein the points awarded vary depending on the size, location, or orientation of the ball-receiving cup into which the player successfully putted the ball.

* * * * *